US009488959B2

(12) United States Patent
Ishii

(10) Patent No.: US 9,488,959 B2
(45) Date of Patent: Nov. 8, 2016

(54) IMAGE FORMING APPARATUS THAT ENSURES COOLING PERFORMANCE OF TONER CONTAINER AND DOWNSIZED IMAGE FORMING APPARATUS

(71) Applicant: KYOCERA Document Solutions Inc., Osaka (JP)

(72) Inventor: Takeshi Ishii, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/976,762

(22) Filed: Dec. 21, 2015

(65) Prior Publication Data

US 2016/0187847 A1 Jun. 30, 2016

(30) Foreign Application Priority Data

Dec. 25, 2014 (JP) ..... 2014-261559

(51) Int. Cl.

| | |
|---|---|
| ***G03G 21/20*** | (2006.01) |
| ***G03G 15/01*** | (2006.01) |
| *G03G 15/08* | (2006.01) |
| *G03G 21/16* | (2006.01) |

(52) U.S. Cl.

CPC ..... *G03G 21/206* (2013.01); *G03G 15/0142* (2013.01); *G03G 15/0189* (2013.01); *G03G 15/0865* (2013.01); *G03G 21/1619* (2013.01); *G03G 2221/1645* (2013.01); *G03G 2221/1654* (2013.01)

(58) Field of Classification Search

CPC ..... G03G 21/206

See application file for complete search history.

(56) References Cited

U.S. PATENT DOCUMENTS 6,308,024 B1 * 10/2001 Nakayama ..... B41J 29/12 399/92
7,792,456 B2 * 9/2010 Okamoto ..... G03G 21/20 399/13
2006/0083555 A1 * 4/2006 Uchiyama ..... G03G 15/0872 399/258
2009/0110412 A1 * 4/2009 Kakita ..... G03G 15/0877 399/27
2009/0175647 A1 * 7/2009 Suzuki ..... G03G 21/206 399/92
2010/0021211 A1 * 1/2010 Ogawa ..... G03G 21/1619 399/262
2011/0182610 A1 * 7/2011 Ohmura ..... G03G 21/206 399/94
2011/0280609 A1 * 11/2011 Nakazawa ..... G03G 21/206 399/92
2013/0142540 A1 * 6/2013 Kaneko ..... G03G 15/0189 399/101
2014/0126925 A1 * 5/2014 Ueno ..... G03G 21/206 399/92
2014/0321877 A1 * 10/2014 Ono ..... G03G 15/6552 399/92

FOREIGN PATENT DOCUMENTS

JP 2010-66429 A 3/2010

* cited by examiner

*Primary Examiner* — David Gray
*Assistant Examiner* — Carla Therrien
(74) *Attorney, Agent, or Firm* — Stein IP, LLC

(57) ABSTRACT

An image forming apparatus includes a frame member, an intermediate transfer unit, a plurality of image forming units, a plurality of toner containers. The frame member defines a plurality of concave portions to accommodate respective lower end portions of the toner containers, and includes an upper frame portion located to cover a top surface of an intermediate transfer belt. One concave portion among the plurality of the concave portions defined by a wall portion defines a vent hole. The upper frame portion defines a ventilation path located at an opposite side of the one concave portion with respect to the wall portion and communicating with the one concave portion via the vent hole. The image forming apparatus further includes a blast fan to discharge air in the ventilation path from the vent hole to a side of the one concave portion.

6 Claims, 10 Drawing Sheets

IMAGE FORMING APPARATUS THAT ENSURES COOLING PERFORMANCE OF TONER CONTAINER AND DOWNSIZED IMAGE FORMING APPARATUS

INCORPORATION BY REFERENCE

This application is based upon, and claims the benefit of priority from, corresponding Japanese Patent Application No. 2014-261559 filed in the Japan Patent Office on Dec. 25, 2014, the entire contents of which are incorporated herein by reference.

BACKGROUND

Unless otherwise indicated herein, the description in this section is not prior art to the claims in this application and is not admitted to be prior art by inclusion in this section.

There is known an image forming apparatus that includes an intermediate transfer unit. The intermediate transfer unit unitizes a drive roller, a tension roller, and an intermediate transfer belt stretching around both rollers via a frame member. At a lower side of the intermediate transfer unit, a plurality of image forming units located along a running direction of the intermediate transfer belt. When an image is formed, a primary transfer roller sequentially transfers toner images of respective-colors formed by the plurality of the image forming units onto the intermediate transfer belt. Then, the transferred toner images are transferred by a secondary transfer roller onto a paper sheet at once. At an upper side of the intermediate transfer belt, a plurality of toner containers, which house color toners corresponding to the respective image forming units, are located.

Here, the image forming apparatus includes various kinds of heat sources such as a fixing unit. This causes a problem that a toner is aggregated by heat that is from this heat source, and heats an inside of the toner container.

For example, to solve this problem, there is disclosed an image forming apparatus that includes a ventilation path located between a toner container and a sheet discharge tray, which is located at an upper side of this toner container, causes a blast fan to generate airflow in this the ventilation path, thus cooling the respective toner containers.

SUMMARY

In an example embodiment according to this disclosure, an image forming apparatus according to one aspect of the disclosure includes a frame member, an intermediate transfer unit, a plurality of image forming units, a plurality of toner containers. The intermediate transfer unit includes a drive roller and a tension roller supported by the frame member and an intermediate transfer belt stretching around the drive roller and the tension roller. The plurality of image forming units that are located at a lower side of the intermediate transfer unit are located along a running direction of the intermediate transfer belt. The plurality of toner containers is located at an upper side of the intermediate transfer belt corresponding to the respective image forming units to supply the respective image forming units with toners. The frame member defines a plurality of concave portions to accommodate respective lower end portions of the toner containers, and includes an upper frame portion located to cover a top surface of the intermediate transfer belt. One concave portion among the plurality of the concave portions defined by a wall portion defines a vent hole. The upper frame portion defines a ventilation path located at an opposite side of the one concave portion with respect to the wall portion and communicating with the one concave portion via the vent hole. The image forming apparatus further includes a blast fan to discharge air in the ventilation path from the vent hole to a side of the one concave portion.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
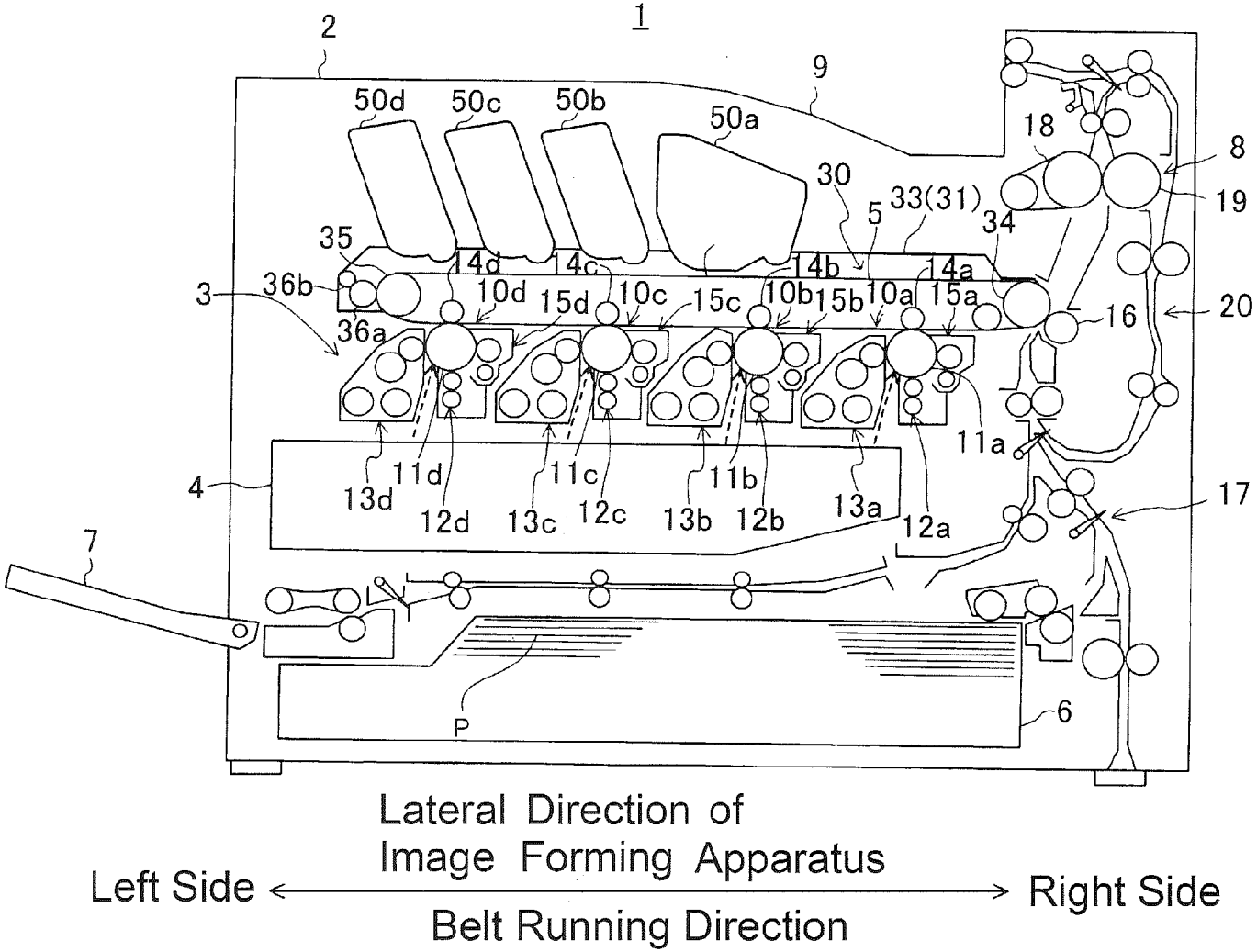
FIG. 1 schematically illustrates an internal structure of an image forming apparatus according to Embodiment 1 of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be located, substituted, combined, separated, and designed in a wide variety of different configurations, all of which are explicitly contemplated herein.

The following describes embodiments of the disclosure in detail based on the drawings. The disclosure is not limited to the following embodiments.

Embodiment 1

FIG. 1 illustrates a schematic configuration of an image forming apparatus 1 according to Embodiment 1 of the disclosure. In the following description, "front side" and "rear side" respectively denote a front side and a rear side of the image forming apparatus 1, "left side" and "right side" respectively denote a left side and a right side of the image forming apparatus 1 viewed from the front side.

The above-described image forming apparatus 1 is a tandem type color printer, and includes an image forming apparatus body 2 and an image forming unit 3 housed in this image forming apparatus body 2.

This image forming unit 3 is a unit that transfers and forms an image based on image data transmitted from an external device such as a computer connecting, for example, a network on a recording sheet P. An exposure apparatus 4, which irradiates with a laser beam, is located at a lower side of the image forming unit 3. An intermediate transfer unit 30, which includes an intermediate transfer belt 5, is located at an upper side of the image forming unit 3. Four toner containers 50*a* to 50*d* are located along the intermediate transfer belt 5 at an upper side of the intermediate transfer unit 30. A paper sheet storage unit 6, which retains the recording sheets P, is located at a lower side of the exposure apparatus 4. A manual paper feed tray 7 is located at a side portion of the paper sheet storage unit 6. A fixing unit 8, which performs a fixing process to the image transferred and formed on the recording sheet P, is located at a lateral upper portion of the intermediate transfer belt 5. A paper sheet discharge unit 9 is located at an upper portion of the image forming apparatus body 2, and discharges the recording sheet P on which the fixing process has been performed by the fixing unit 8.

The image forming unit 3 includes four image forming units 10*a* to 10*d* located in a row along the intermediate transfer belt 5. The image forming unit 10*a* forms a black toner image, the image forming unit 10*b* forms a yellow toner image, the image forming unit 10*c* forms a magenta toner image, and the image forming unit 10*d* forms a cyan toner image. The image forming units 10*a* to 10*d* include photoreceptor drums 11*a* to 11*d* as image carriers. Chargers 12*a* to 12*d* are located immediately below the respective photoreceptor drums 11*a* to 11*d*. Developing devices 13*a* to 13*d* are located at one side portion of the respective photoreceptor drums 11*a* to 11*d*. Primary transfer rollers 14*a* to 14*d* are located immediately above the respective photoreceptor drums 11*a* to 11*d*. Cleaning units (hereinafter referred to as cleaning apparatuses) 15*a* to 15*d*, which clean circumference surfaces of the photoreceptor drums 11 (11*a* to 11*d*), are located at the other side portion of the respective photoreceptor drums 11.

The chargers 12 (12*a* to 12*d*) evenly charge the circumference surfaces of the respective photoreceptor drums 11*a* to 11*d*. Then, the exposure apparatus 4 irradiates the circumference surfaces of the photoreceptor drums 11 after this charge with the laser beam corresponding to the respective colors based on image data input from, for example, the computer described above to form an electrostatic latent image on the circumference surfaces of the respective photoreceptor drums 11*a* to 11*d*. The developing devices 13 (13*a* to 13*d*) supply the electrostatic latent image with a developer to form the yellow, magenta, cyan, and black toner images on the circumference surfaces of the respective photoreceptor drums 11*a* to 11*d*. Transfer biases applied to the primary transfer rollers 14 (14*a* to 14*d*) overlap and transfer these respective toner images on the intermediate transfer belt 5.

Figure 2:
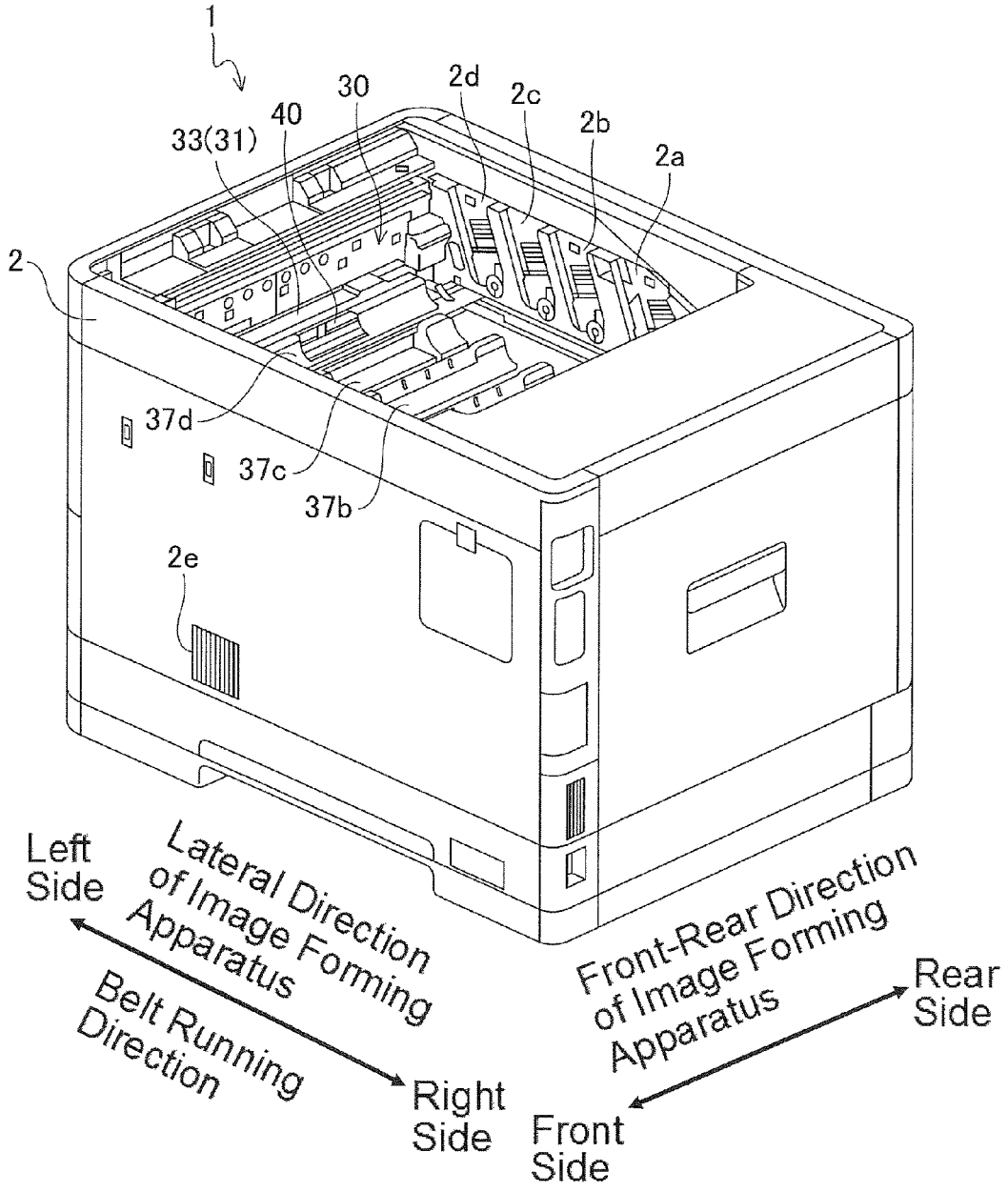
FIG. 2 obliquely illustrates a state where an upper cover and a toner container are removed from the image forming apparatus according to Embodiment 1.

The above-described four toner containers 50*a* to 50*d* located at an upper side of the intermediate transfer belt 5 respectively house black, yellow, magenta, and cyan toners. Then, the respective toner containers 50*a* to 50*d* are constituted to supply the developing devices 13 corresponding to respective colors with the toners. The toner containers 50*a* to 50*d* each have a long and hollow-shaped case body in a front-rear direction of the image forming apparatus 1. The toner containers 50*a* to 50*d* are engaged with respective engaging grooves 2*a* to 2*d* (see FIG. 2), whose both end portions in a longitudinal direction are located in the image forming apparatus body 2, so as to be mounted in the this image forming apparatus body 2.

A secondary transfer roller 16 is located around a right-side end portion of the intermediate transfer belt 5 described above. The secondary transfer roller 16 is located in a state of abutting on the intermediate transfer belt 5 at a lower side of the fixing unit 8. The secondary transfer roller 16 sandwiches the recording sheet P conveyed from the paper sheet storage unit 6 or the manual paper feed tray 7 to a paper sheet conveyance path 17 between the intermediate transfer belt 5 and the secondary transfer roller 16. The transfer bias is applied to the secondary transfer roller 16. This transfer bias transfers the toner image on the intermediate transfer belt 5 onto the recording sheet P.

The fixing unit 8 includes a heating roller 18 and a pressure roller 19. These heating roller 18 and pressure roller 19 heat and apply pressure onto the recording sheet P while sandwiching the recording sheet P to fix the toner image transferred on the recording sheet P on the recording sheet P. The paper sheet discharge unit 9 discharges the recording sheet P after the fixing process. An inverting conveyance path 20 in FIG. 1 is a conveyance path for inverting the recording sheet P discharged from the fixing unit 8 in a duplex printing.

Figure 3:
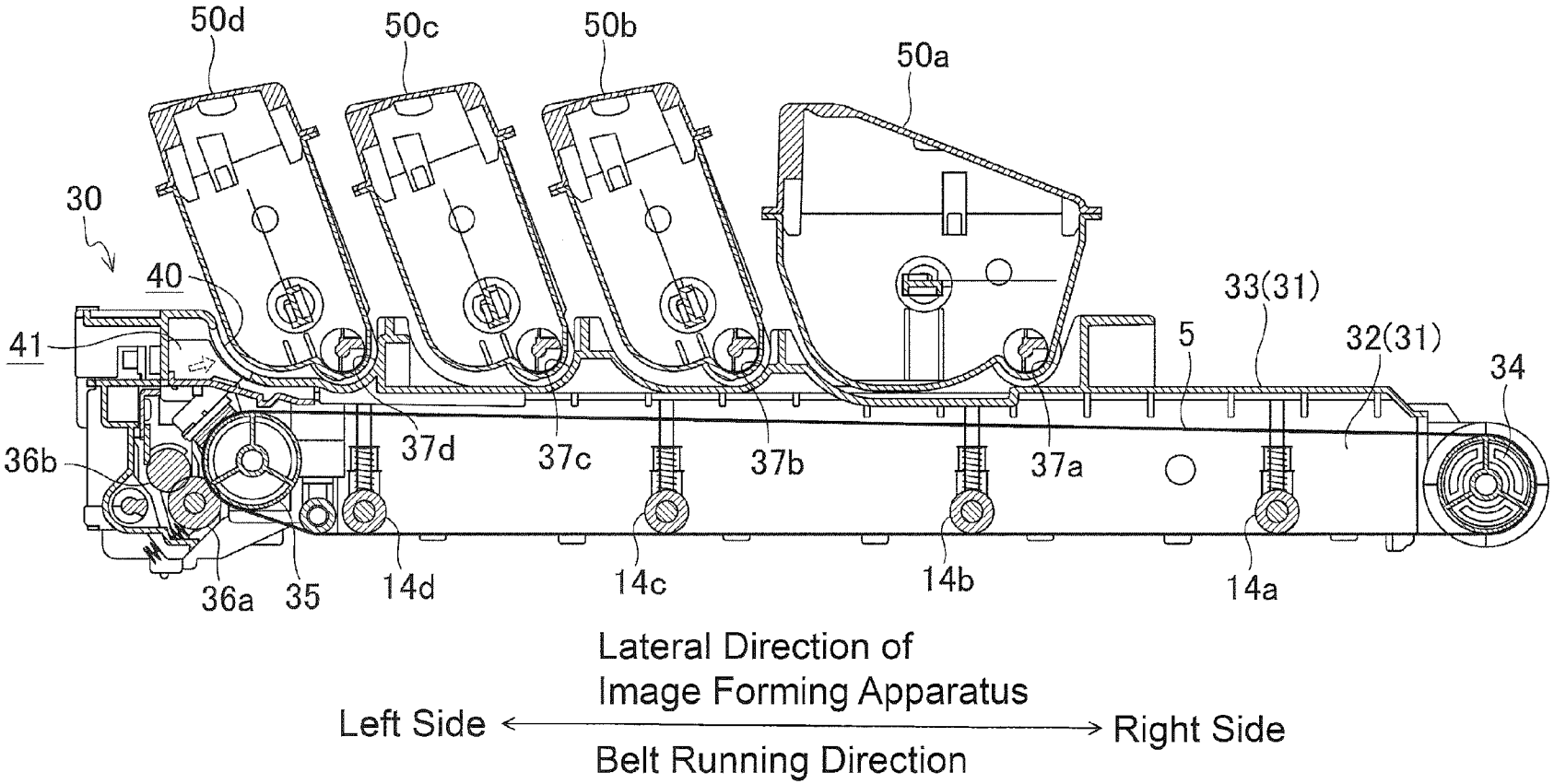
FIG. 3 illustrates a vertical cross section of an intermediate transfer unit according to Embodiment 1.

As illustrated in FIG. 3, the intermediate transfer unit 30 includes a metallic frame member 31. The frame member 31 includes a pair of lateral frame portions 32 and an upper frame portion 33. The pair of the lateral frame portions 32 are located at an interval one another in the front-rear direction of the image forming apparatus 1. The pair of the lateral frame portions 32 turnably supports a drive roller 34 and a tension roller 35. The drive roller 34 and the tension roller 35 are located at an interval one another in a lateral direction of the image forming apparatus 1. The above-described intermediate transfer belt 5 stretches around this drive roller 34 and the tension roller 35. At a left-side end portion of the frame member 31, a fur brush 36*a* and a cleaning roller 36*b* are supported for removing a residual toner attached on an outer peripheral surface of the above-described intermediate transfer belt 5. The fur brush 36*a* is located facing the tension roller 35 across the intermediate transfer belt 5, and abuts on the outer peripheral surface of this intermediate transfer belt 5. The fur brush 36*a* is also referred to simply as a cleaning member. The cleaning roller 36*b* is located to have a circumference surface to abut on a circumference surface of the fur brush 36*a*. Thus, the cleaning roller 36*b* removes a toner attached on the fur brush 36*a*.

The above-described upper frame portion 33, which is across the pair of the lateral frame portions 32, is secured to their top surfaces. The upper frame portion 33 is located to cover the whole top surface of the intermediate transfer belt 5. On a top surface of the upper frame portion 33, concave portions 37*a* to 37*d* are located to accommodate lower end portions of the toner containers 50*a* to 50*d*. The respective concave portions 37*a* to 37*d* are located at an interval one another in the running direction of the intermediate transfer belt 5 corresponding to mounting positions of the respective toner containers 50*a* to 50*d*. The respective concave portions 37*a* to 37*d* extend in the belt width direction (front-rear direction) orthogonal to the running direction of the intermediate transfer belt 5 in a plan view. The respective concave portions 37*a* to 37*d* open to an upper side viewed from the belt width direction. The respective concave portions 37*a* to 37*d* are configured by a pair of sidewall portions 38 and a bottom wall portion 39 as enlargedly illustrated in FIG. 4. The pair of the sidewall portions 38 face one another in a lateral direction (belt running direction). A right-side sidewall portion 38 is vertically located. In contrast, a left-side sidewall portion 38 is inclined to a lower side toward a right side corresponding to an inclination of the toner containers 50*a* to 50*d*. The bottom wall portion 39 connects between lower end portions of the pair of the sidewall portion 38 together.

Figure 4:
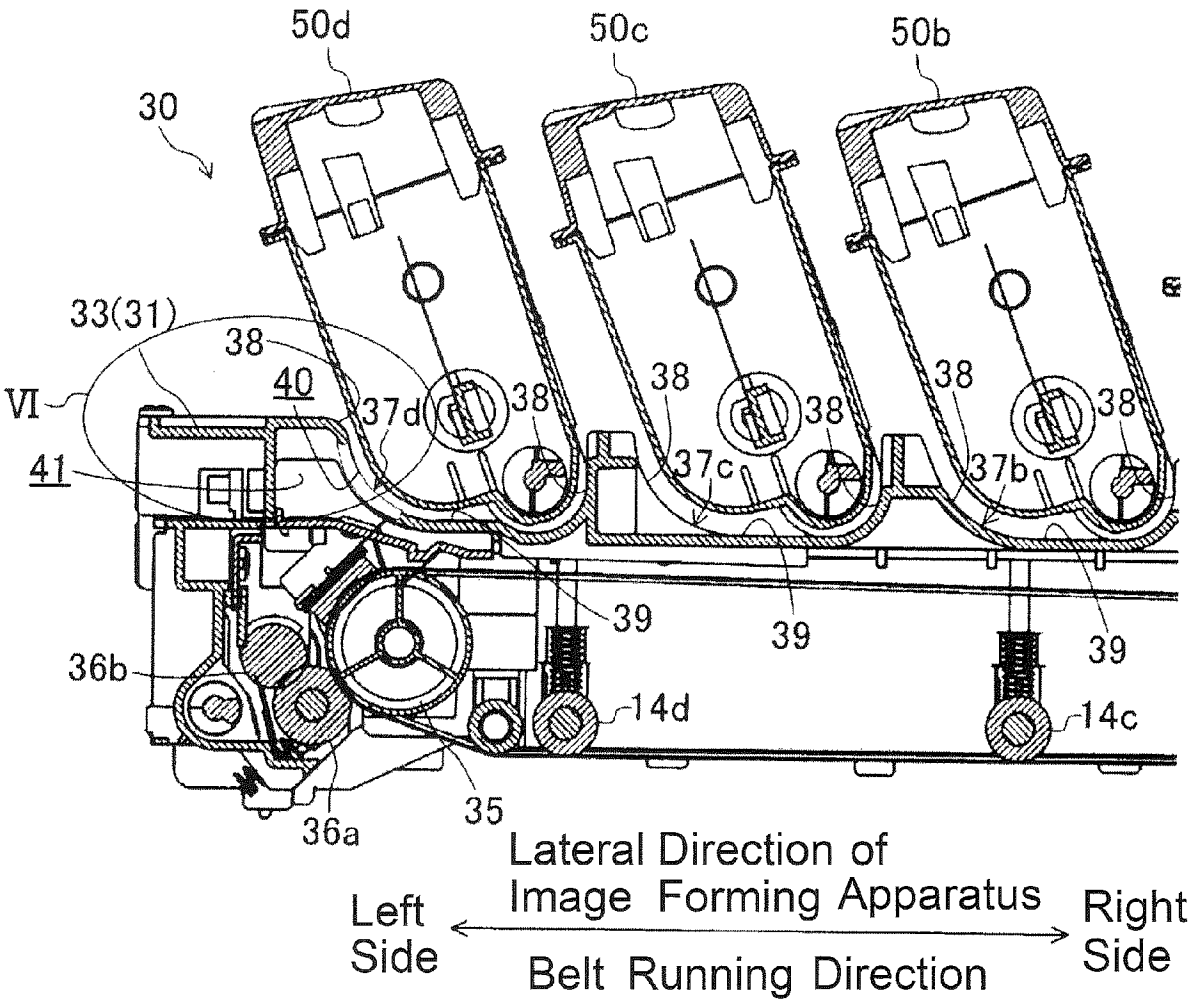
FIG. 4 illustrates an enlarged cross section of a left-side end portion of the intermediate transfer unit according to Embodiment 1.
Figure 5:
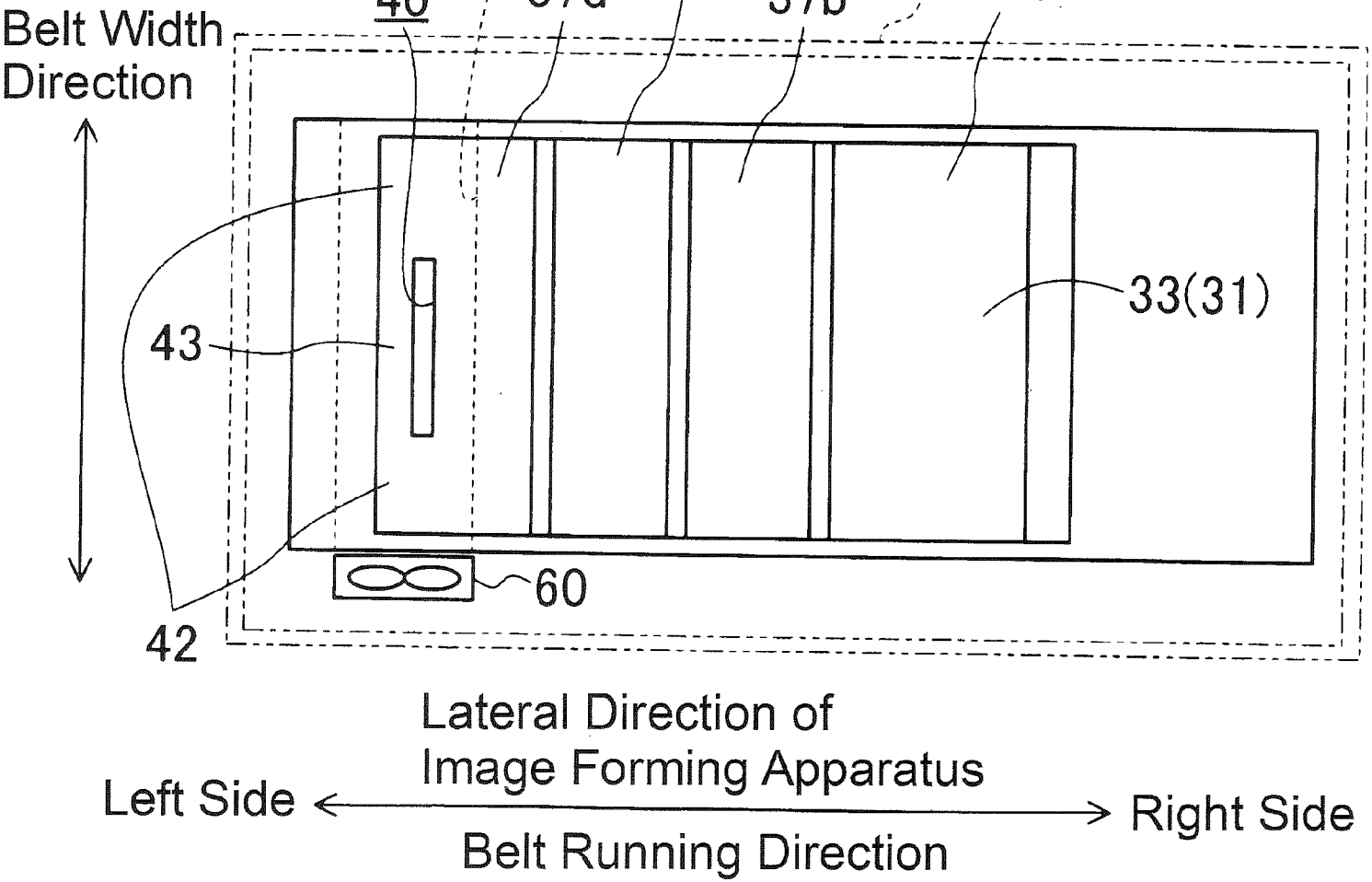
FIG. 5 illustrates a plan view of the intermediate transfer unit according to Embodiment 1 viewed from an upper side.

As illustrated in FIGS. 4 and 5, a vent hole 40 is located on the concave portion 37*d*, which is at the leftmost side. This concave portion 37*d* is located at an upper side of the fur brush 36*a*. The vent hole 40 is configured by the left-side sidewall portion 38 forming the concave portion 37*d*. A hollow-shaped ventilation path 41 is located on an opposite side of this concave portion 37*d* with respect to the sidewall portion 38.

The above-described vent hole 40 is an elongated hole-shaped through-hole extending in the belt width direction. The vent hole 40 has a size designed to, for example, a size enough to accommodate four fingers from a little finger to an index finger or slightly larger than this size. The vent hole 40 is formed over the whole intermediate portion other than both the end portions of the belt width direction on the left-side sidewall portion 38. Both these end portions (that is, a portion adjacent to both sides of the belt width direction of the vent hole 40 on the sidewall portion 38) functions as a guide wall portion 42, which guides an insertion of the toner container 50*d*.

Figure 6:
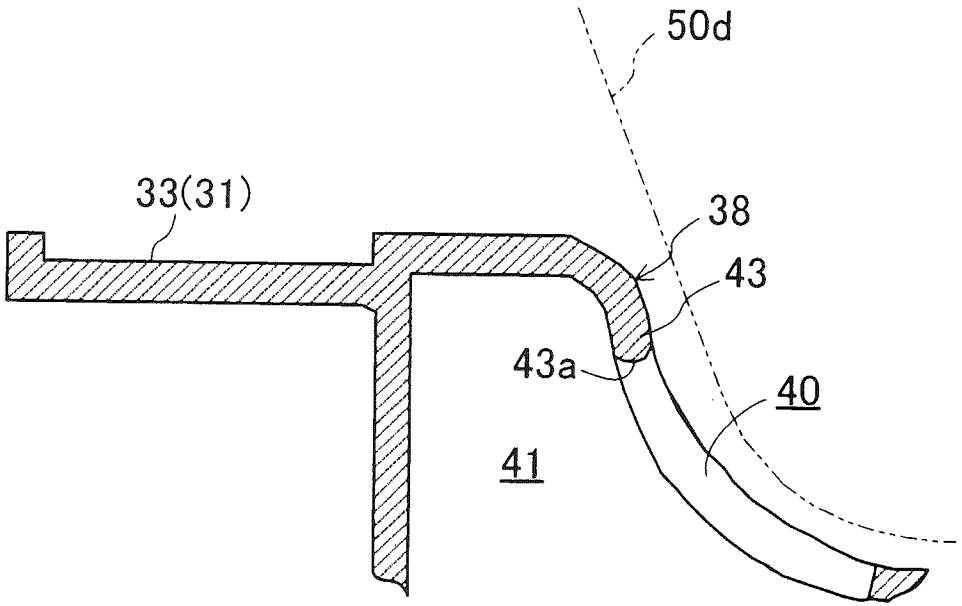
FIG. 6 enlargedly illustrates a VI portion illustrated in FIG. 4.

As illustrated in FIG. 6, the vent hole 40 is formed with a remained upper end portion of the left-side sidewall portion 38. This upper end portion functions as a handle portion 43 that a user can hold with his/her fingers. The handle portion 43 includes a distal end portion 43*a* with an edge portion on which a round chamfering is performed.

Returning to FIGS. 4 and 5, the ventilation path 41 communicates with the concave portion 37*d* via the vent hole 40. As illustrated in FIG. 5, the vent hole 40 extends in the front-rear direction (belt width direction). The vent hole 40 is formed to slide into under from a left side of a lower end portion of the toner container 50*d* to the lower side (see FIG. 4). A rear end of the vent hole 40 is closed, while a front end of the vent hole 40 is opened. A blast fan 60 (see FIG. 5) is located near a front sidewall of the image forming apparatus body 2 facing an opening of this vent hole 40. The blast fan 60 of Embodiment 1 is a member separated from the intermediate transfer unit 30, and secured to the image forming apparatus body 2. However, the blast fan 60 may be integrated into the intermediate transfer unit 30. The blast fan 60 supplies the vent hole 40 with external cool air suctioned from an intake air hole 2*e* (see FIG. 2) located on the front sidewall of the image forming apparatus body 2. The supplied air is blown into the concave portion 37*d* from the vent hole 40. This can efficiently cool the lower end portion of the toner container 50*d* located at the concave portion 37*d* using the airflow blown from the vent hole 40. Consequently, this can reduce aggregation of the toners in the toner container 50*d* due to heat from various kinds of the heat sources in the image forming apparatus body 2. According to Embodiment 1 described above, the ventilation path 41 as a cooling air passage is integrally located into the intermediate transfer unit 30. This ensures the whole downsized image forming apparatus 1. The vent hole 40 of Embodiment 1 described above has a size enough to accommodate human hand fingers (in Embodiment 1 described above, four fingers from a little finger to an index finger). Thus, holding the handle portion 43 (see FIG. 6) with, for example, the four fingers of one hand through the vent hole 40 for attaching and removing operation of the intermediate transfer unit 30 ensures easily lifting a whole intermediate transfer unit 30.

Additionally, in Embodiment 1 described above, the handle portion 43 includes the distal end portion 43*a* with the edge on which the round chamfering is performed. Thus, the user can hold the handle portion 43 without feeling a pain in his/her hand.

The vent hole 40 of Embodiment 1 described above is located at the concave portion 37*d* located at the upper side of the fur brush 36*a* abutting on the intermediate transfer belt 5.

This reliably ensures the reduced toner aggregation caused by the lower end portion of the toner container 50*d* heated due to frictional heat between the fur brush 36*a* and the intermediate transfer belt 5.

In Embodiment 1 described above, the portion adjacent to both ends of the belt width direction of the vent hole 40 in the sidewall portions 38 of the above-described concave portion 37*d* is the guide wall portion 42, which guides the insertion of the toner container 50*d*.

Thus, the guide wall portion 42 ensures the guide of the toner container 50*d* when both the end portions of the toner container 50*d* are inserted into the engaging groove 2*d* of the image forming apparatus body 2. This ensures the facilitated insertion operation of the toner container 50*d* by the user. Additionally, this eliminates the need for an additional guiding member that guides the insertion of the toner container 50*d*. This ensures the reduced product cost by this member.

Embodiment 2

Figure 7:
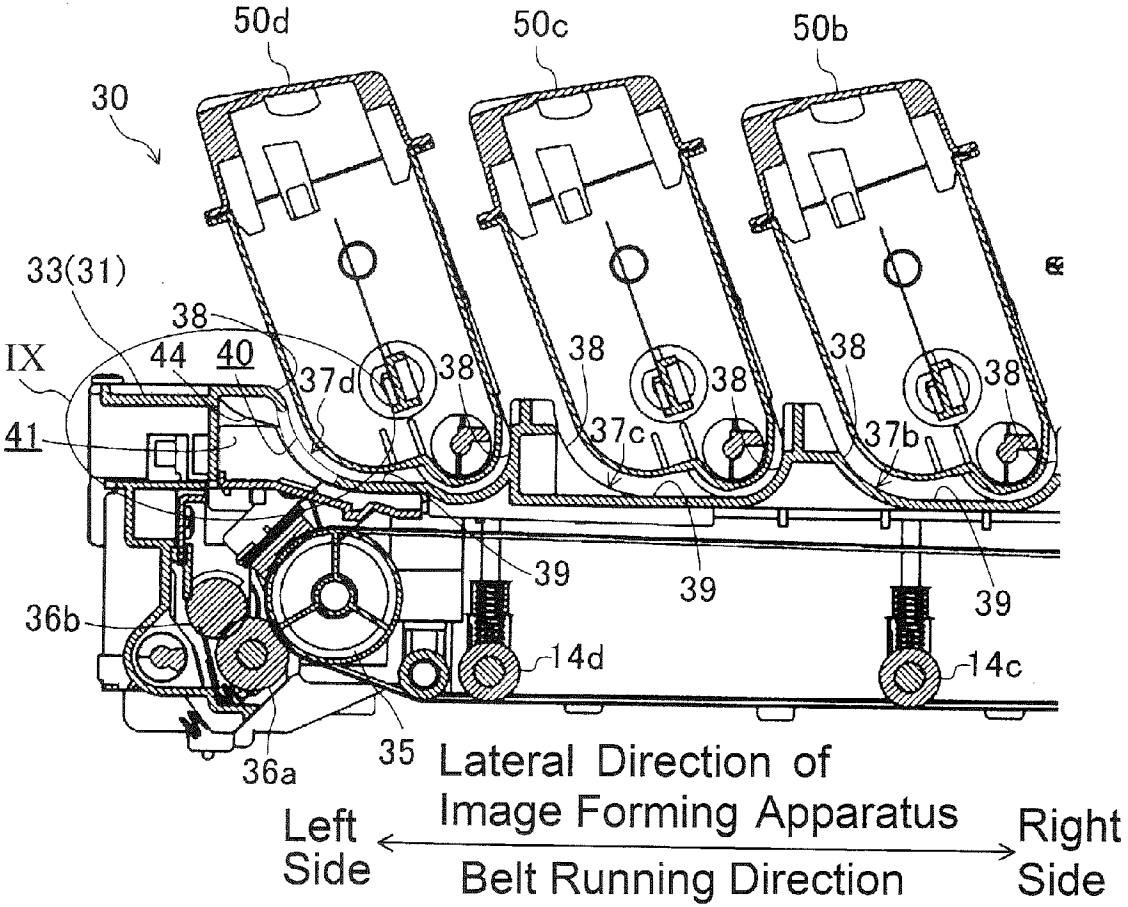
FIG. 7 illustrates an enlarged cross section of a left-side end portion of an intermediate transfer unit according to Embodiment 2.
Figure 8:
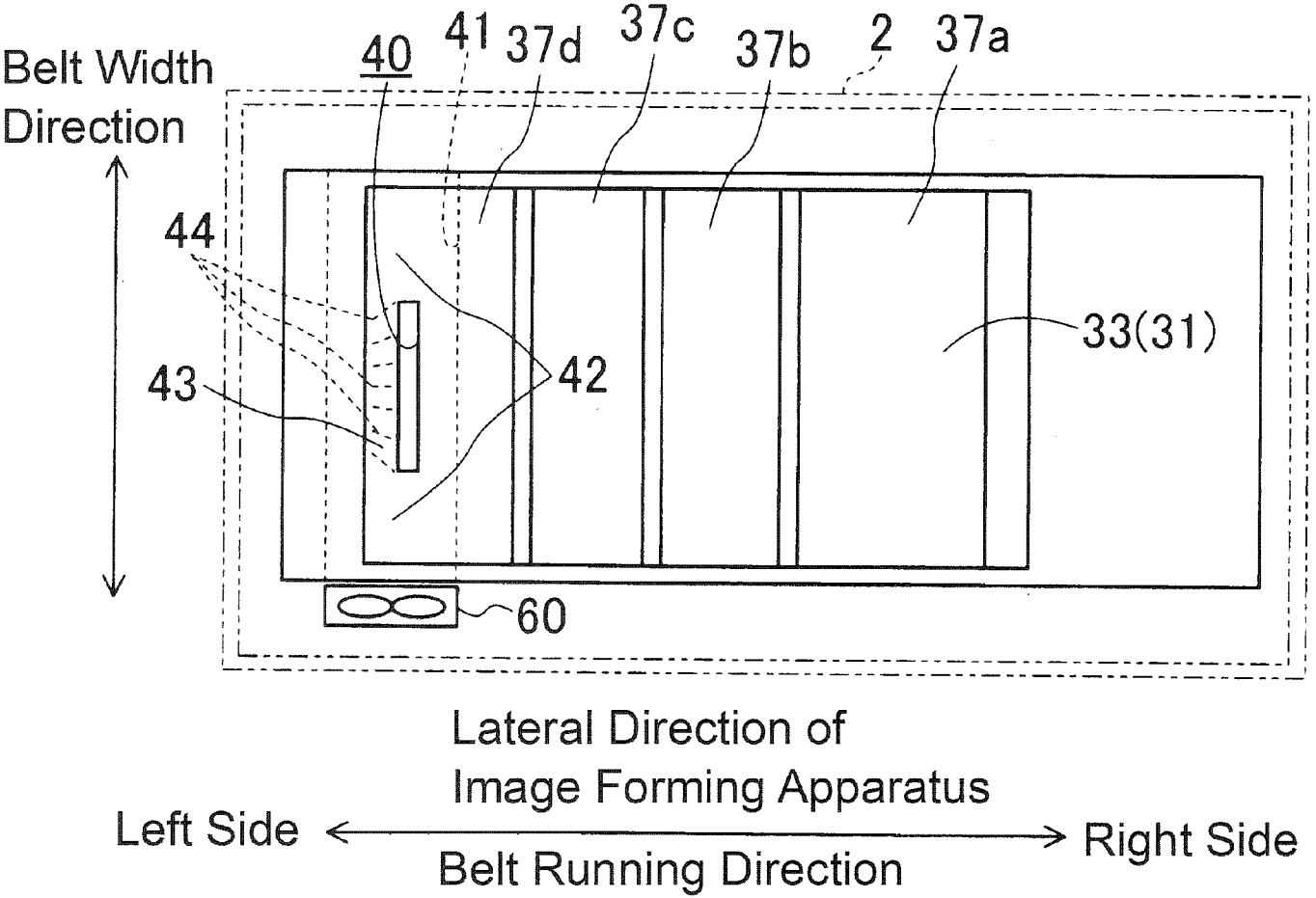
FIG. 8 illustrates a plan view of the intermediate transfer unit according to Embodiment 2 viewed from an upper side.
Figure 9:
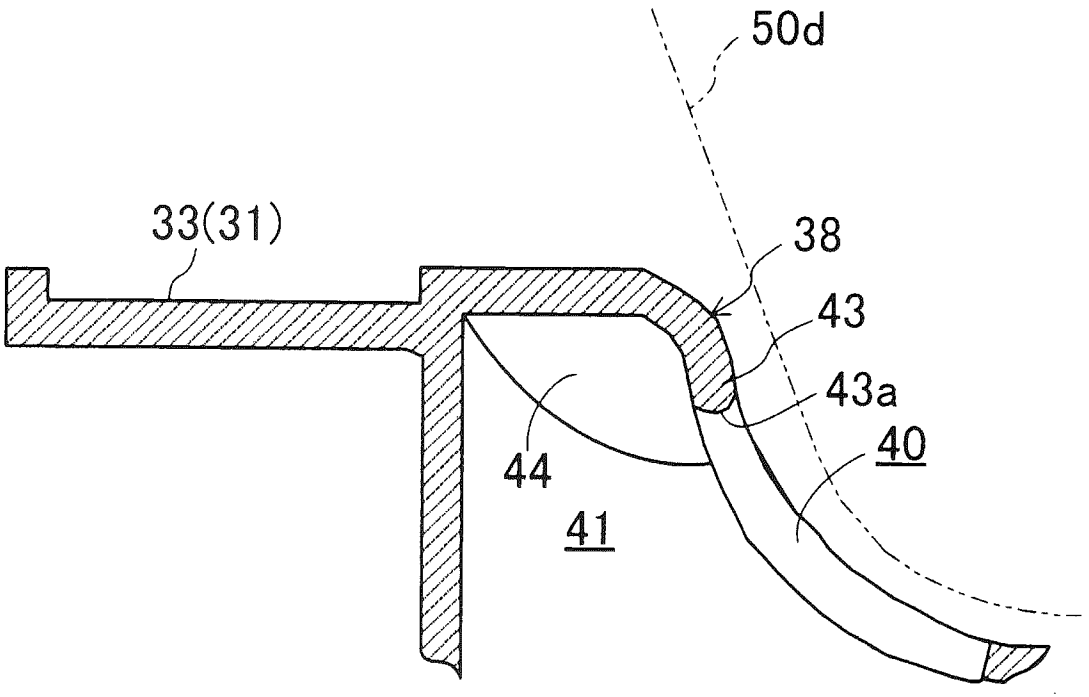
FIG. 9 enlargedly illustrates a IX portion illustrated in FIG. 7.

FIGS. 7 to 9 illustrates Embodiment 2. Embodiment 2 is different from Embodiment 1 described above in that Embodiment 2 includes a vertical plate portion 44 that guides the air in the ventilation path 41 to the vent hole 40. The detailed description is omitted using the identical signs in FIGS. 4 to 6 for configuration elements in FIGS. 7 to 9 identical to those in FIGS. 4 to 6.

Namely, a plurality of the vertical plate portions 44 are located at a portion adjacent to the vent hole 40 at an upper wall surface of the ventilation path 41 in the embodiment. The plurality of the vertical plate portions 44 vertically hang from the upper wall surface of the ventilation path 41 downward. The plurality of the vertical plate portions 44 are located at an interval one another in the front-rear direction (belt width direction). The intervals between the vertical plate portions 44 adjacent to one another increase as approaching from an inner side of the ventilation path 41 to a side of the vent hole 40 (see FIG. 8).

According to this configuration, the plurality of the vertical plate portions 44 ensures the reliable guide of the air in the ventilation path 41 to the vent hole 40. Consequently, this ensures the sufficient air flow rate blown from the vent hole 40 so as to reliably cool the lower end portion of the toner container 50*d*. The intervals between the respective vertical plate portions 44 become wider as approaching the side of the vent hole 40. This ensures the air in the ventilation path 41 evenly blown from the whole longitudinal direction of the vent hole 40 thanks to diffuser effect. Consequently, the whole lower end portion of the toner container 50*d* is uniformly cooled. This additionally prevents a toner in the toner container 50*d* from being locally aggregated.

As illustrated in FIG. 9, it is preferred that the lower end surfaces of the respective vertical plate portions 44 are curved to the upper side from the side of the vent hole 40 toward the inner side of the ventilation path 41.

With this configuration, appropriately bending the human hand fingers entered from the vent hole 40 ensures the easy press of the balls of fingers onto the lower end surfaces of the respective vertical plate portions 44 when attaching or removing the intermediate transfer unit 30. This ensures the facilitated attaching and removing operation of the intermediate transfer unit 30.

Other Embodiments

Figure 10:
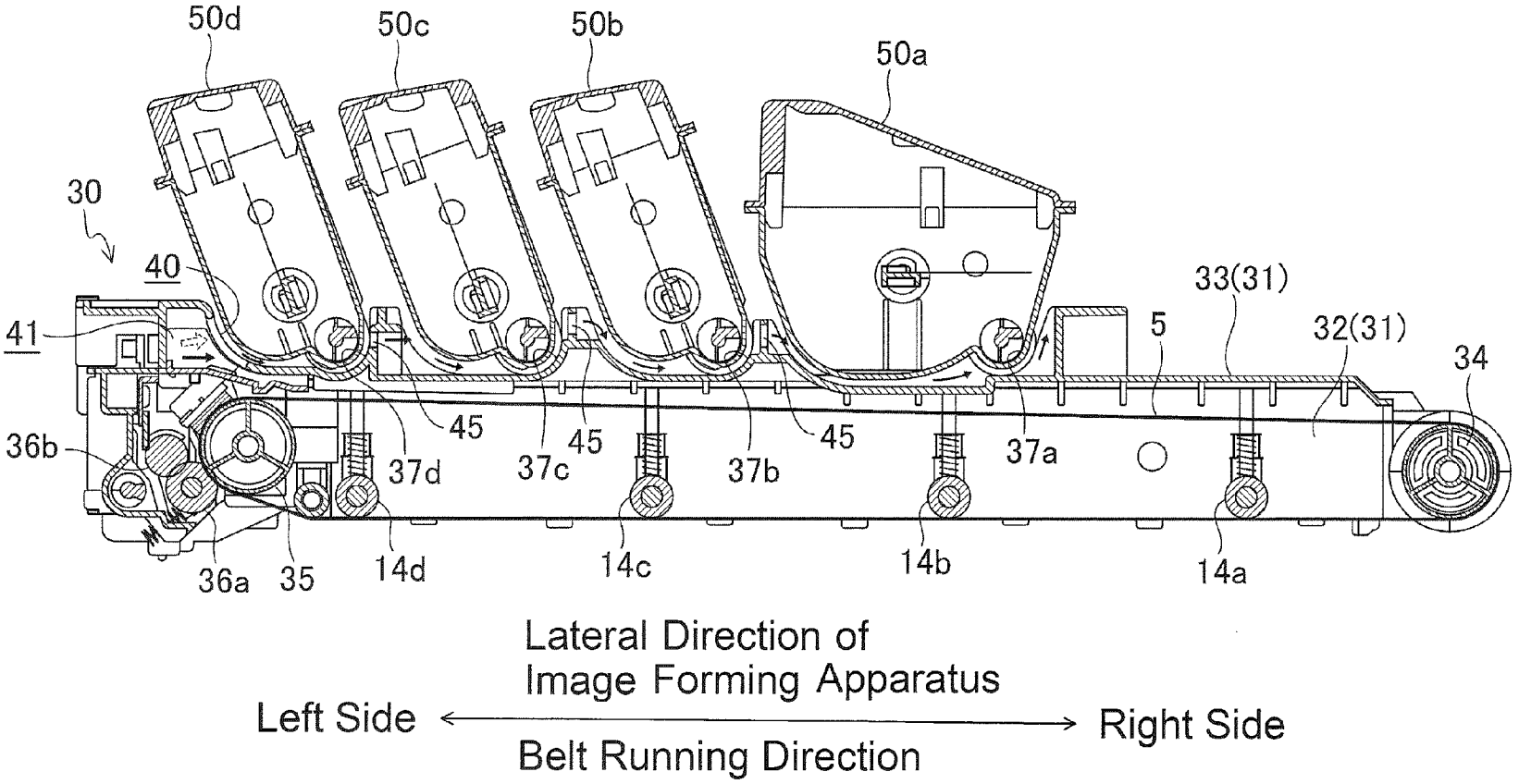
FIG. 10 illustrates a vertical cross section of an intermediate transfer unit of another embodiment.

While in the embodiments described above includes a configuration where the airflow blown from the vent hole 40 is blown onto only the toner container 50*d*, which is on the most left side, this should not be construed in a limiting sense. Namely, as illustrated in FIG. 10, a communication hole 45 may be formed in the upper frame portion 33 to communicate between the respective concave portions 37*a* to 37*c*. Thus, the airflow supplied to the concave portion 37*d* from the communication hole 45 can be supplied to the other concave portions 37*a* to 37*c* via the respective communication holes 45 (see black arrows illustrated in FIG. 10). Consequently, all the toner containers 50*a* to 50*d* located at the respective concave portions 37*a* to 37*d* can be cooled evenly.

While in Embodiment 2 described above the lower end surface of the vertical plate portion 44 is formed to have a curved surface in downward convex viewed from a thickness direction, this should not be construed in a limiting sense. For example, the lower end surface of the vertical plate portion 44 may be formed to have a curved surface in upward convex. This causes the fingertip to fit to this concave portion, and then causes an easy lifting of the intermediate transfer unit 30.

As described above, the disclosure is effective to an image forming apparatus.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus, comprising:

a frame member;

an intermediate transfer unit that includes a drive roller and a tension roller supported by the frame member and an intermediate transfer belt stretching around the drive roller and the tension roller;

a plurality of image forming units located at a lower side of the intermediate transfer unit and located along a running direction of the intermediate transfer belt; and a plurality of toner containers located at an upper side of the intermediate transfer belt corresponding to the respective image forming units to supply the respective image forming units with toners, wherein the frame member defines a plurality of concave portions to accommodate respective lower end portions of the toner containers, and includes an upper frame portion located to cover a top surface of the intermediate transfer belt, each of the plurality of concave portions has a pair of sidewall portions and a bottom wall portion connected between lower end portions of the pair of the sidewall portions together, one concave portion among the plurality of the concave portions is defined by one of the pair of sidewall portions, the one of the pair of sidewall portions defining a vent hole, the upper frame portion defines a ventilation path located at an opposite side of the one concave portion with respect to the one of the pair of the sidewall portions, the ventilation path communicating with the one concave portion via the vent hole, and the image forming apparatus further includes a blast fan to discharge air in the ventilation path from the vent hole to a side of the one concave portion.

2. The image forming apparatus according to claim 1, wherein the intermediate transfer unit includes a cleaning member that is turnably supported by the frame member, located facing the tension roller across the intermediate transfer belt, and abuts on an outer peripheral surface of the intermediate transfer belt to remove a residual toner attached on the outer peripheral surface, and the one concave portion is located at an upper side of the cleaning member.

3. The image forming apparatus according to claim 1, wherein the upper frame portion defines a communication hole communicating between respective adjacent concave portions.

4. The image forming apparatus according to claim 1, wherein an upper end portion of the one sidewall portion includes chamfering.

5. The image forming apparatus according to claim 1, wherein the one concave portion is defined to extend in a belt width direction orthogonal to the running direction of the intermediate transfer belt in a plan view, and a portion, adjacent to both ends of the belt width direction of the vent hole in the one of the pair of sidewall portions at the frame member, functions as a guiding wall portion that guides an insertion of a toner container.

6. The image forming apparatus according to claim 1, wherein the vent hole is defined in an elongated hole shape extending in a belt width direction orthogonal to the running direction of the intermediate transfer belt, a portion adjacent to the vent hole at an upper wall surface of the ventilation path includes vertical plate portions that guide airflow in the ventilation path to the vent hole, the vertical plate portions being located at an interval one another in the belt width direction, and the interval between the vertical plate portions adjacent to one another increases as approaching from an inner side of the ventilation path to a side of the vent hole.

* * * * *